United States Patent [19]

Shaffer et al.

[11] 4,040,703

[45] Aug. 9, 1977

[54] TRI-LEAD CABLE CONNECTOR

[75] Inventors: Howard Richard Shaffer, Westminister, Md.; Robert Houston Frantz, Carlisle, Pa.

[73] Assignee: AMP Incorporated, Harrisburg, Pa.

[21] Appl. No.: 700,370

[22] Filed: June 28, 1976

Related U.S. Application Data

[63] Continuation-in-part of Ser. No. 610,815, Sept. 9, 1975, abandoned.

[51] Int. Cl.[2] ..... H01R 13/38

[52] U.S. Cl. ..... 339/99 R; 339/210 R; 339/276 SF

[58] Field of Search ..... 339/95, 97–99, 339/210, 276 SF

[56] References Cited

U.S. PATENT DOCUMENTS

| | | | |
|---|---|---|---|
| 3,768,067 | 10/1973 | Rault | 339/99 R |
| 3,836,944 | 9/1974 | Lawson | 339/99 R |
| 3,842,392 | 10/1974 | Aldridge | 339/99 R |
| 3,890,029 | 6/1975 | Izraeli | 339/98 |
| 3,899,236 | 8/1975 | Santos | 339/98 |

FOREIGN PATENT DOCUMENTS

| | | | |
|---|---|---|---|
| 1,929,470 | 2/1970 | Germany | 339/91 R |

*Primary Examiner*—Joseph H. McGlynn
*Attorney, Agent, or Firm*—Russell J. Egan

[57] ABSTRACT

An improved electrical connector assembly is disclosed for terminating multiple conductor cable and, in particular, tri-lead cable. The connector assembly includes a housing having mating top and bottom members molded from rigid insulator material and joined together along one edge by a hinge of resilient insulating material. The housing members define therebetween a pair of contact cavities and at least one cable entry passage leading to the cavities. Top and bottom contacts are inserted into the contact cavities of the respective housing members with portions of the contacts exposed to make an insulation piercing connection with the respective conductors of the cable. Both contacts have opposite end portions adapted to mate with further electrical terminating means. The contacts within the mated housing members can also be probed for electrical continuity.

11 Claims, 13 Drawing Figures

Fig. 8
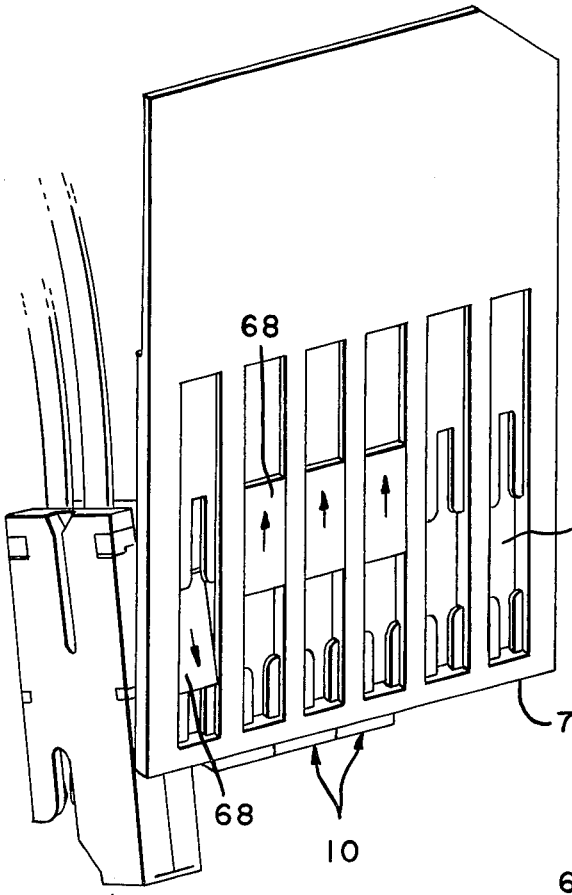
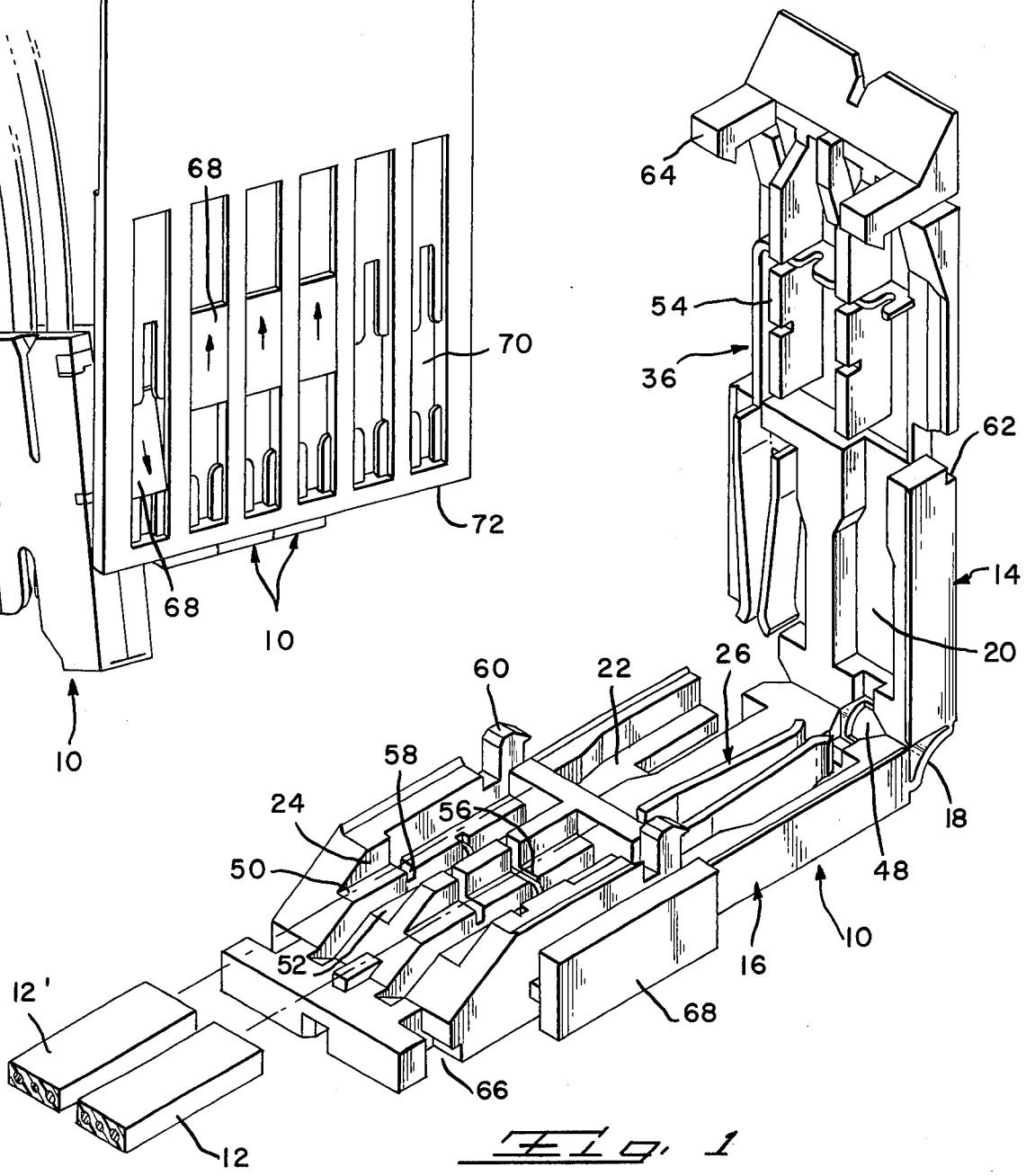
Fig. 1

TRI-LEAD CABLE CONNECTOR

CROSS REFERENCE TO RELATED APPLICATION

The present application is a continuation-in-part of patent application Ser. No. 610,815 filed Sept. 9, 1975, now abandoned.

BACKGROUND OF THE INVENTION

1. The Field Of The Invention

The present invention relates to a disengageable electrical connector assembly for terminating multiple conductor cables and, in particular, to a plug assembly for engaging tri-lead cable with panel boards, printed circuit boards, and the like.

2. Description of the Prior Art

There is a wide variety of electrical connectors that have been used for connecting multi-conductor cables to panel boards, printed circuits, and the like of data processing systems. However, there has been experienced a problem of lack of reliability, versatility, economy, and ruggedness amongst many of these connectors. Modern wiring techniques have created a requirement for new electrical connectors. The advent of micro-miniaturization of printed circuit technology has called forth the need for small sized cable connecting assemblies which can be readily attached and detached and which are adaptable for nesting or ganging to accommodate a plurality of cable connections in a printed circuit board or the like. The ganging feature if particularly desirable in the micro-miniaturization circuitry since many of the connectors are in high density arrays and are of such size as to make individual insertion and extraction extremely difficult.

Flat cables comprising a plurality of small diameter conductors arranged in parallel spaced side-by-side relationship within an insulating plastic jacket enclosing the conductors have been developed recently. These flat cables are particularly well adapted for use in electronics and data processing systems since they have improved flexibility and lower weight volume and cost. They are also more suitable for use in high density applications.

In the prior art, U.S. Pat. No. 3,012,219 discloses a solderless connector for individual insulated small wires wherein no preliminary stripping of insulation is required. The connector penetrates and displaces the insulative covering during application and makes a positive metal to metal connection. U.S. Pat. No. 3,189,863 discloses multiple contact connectors for application to multiple conductor insulated cables consisting of a plurality of parallel, side-by-side, mutually insulated, small diameter copper wires. Means are provided for making electrical contact with the conductors of flat cable without any previous removal of insulation from the cable or conductors. U.S. Pat. No. 3,233,206 shows an electrical connector in which the housing is used to stuff the conductors into a terminating slot which effectively strips the insulation from the wires to form an electrical connection therewith.

In further prior art, U.S. Pat. No. 3,820,005 discloses another type of multi-contact connector for a flat cable in which a base member and a cap piece are assembled to drive slotted beam contact terminals through the conductors to effect the desired electrical connection. U.S. Pat. No. 3,835,444 discloses another slotted plate arrangement for a contact which is mounted in a housing. A portion of the housing is closed to drive the conductor into the slotted plate to effect the electrical connection. U.S. Pat. No. 3,836,944 shows a further type of solderless insulated wire connector which does not require the pre-stripping of the wire to make an electrical connection. A portion of the housing is used to drive the conductors into a slotted beam arrangement which strips the insulation and makes electrical engagement with the conductor.

U.S. Pat. No. 3,874,762 shows an electrical connector particularly designed for use with a tri-lead type of cable. A single contact is arranged to make an insulation piercing engagement with the outer two conductors of the tri-lead cable while a second contact is arranged to engage only the central conductor. The first contact has a single mating portion which can be polarized or of a slightly different configuration from the mating portion of the second contact to effect correct mating of the connector. U.S. Pat. No. 3,673,542 also shows an electrical connector for use with tri-lead type of cable. This connector includes at least two forked connectors one of which is crimped to the signal or center lead and the other of which is crimped to the ground or outer leads of the cable. Thus assembly of this connector would require separation of the conductors of the cable, two crimping operations, and insertion of the contacts into their respective portions of the housing.

SUMMARY OF THE INVENTION

An improved electrical connector assembly for terminating multi-conductor cables with contacts enabling electrical connection with other electrical terminating means includes a housing having top and bottom mating portions molded from a rigid insulation material and defining therebetween at least two contact receiving cavities with at least one cable receiving recess leading thereto. The mating housing members are joined together along one edge by a resilient integral hinge member. At least one latching means is provided on the housing members remote from the hinge. A first contact is received in one of the chambers one housing and has a first portion directed toward the other member adapted to make an insulation piercing engagement with at least one of the conductors of an associated multi-conductor cable. A second contact is receivable in the other chamber in the other housing member with a similar insulation piercing portion directed toward the first member and adapted to engage other conductors of the cable. Both contacts have matable opposite end portions for making engagement with further electrical terminals.

It is therefore an object of the present invention to provide an improved electrical cable connecting device for connecting conductors of a cable with other terminal means attached to a printed circuit board or the like.

It is another object of the present invention to provide an improved cable connector assembly structure for use in conjunction with micro-miniaturized circuitry and which assembly includes means for insuring the precise positioning and connecting of the connector elements within the connector assembly.

It is a still another object of the present invention to provide an improved cable connector construction for use in terminating tri-lead cable.

It is a further object of the present invention to provide an improved cable connector construction having means for removably assembling a plurality of such connectors in gang fashion.

It is a still further object of the present invention to provide an electrical connector which can be probed for checking continuity while the connector is mated in a high density concentration.

It is yet another object of the present invention to provide a cable connector assembly which can be readily and economically manufactured.

The means for accomplishing the foregoing objects and other advantages of the present invention will become apparent to one skilled in the art from the following detailed description taken with reference to the accompanying drawings.

BRIEF DESCRIPTION OF THE DRAWINGS

FIG. 1 is a perspective view of the subject cable connector assembly in an open position;

FIG. 8 is a persepective view of a paddle member used to join a plurality of the subject connector assemblies together in gang fashion;

DETAILED DESCRIPTION OF THE PREFERRED EMBODIMENT

Figure 2:
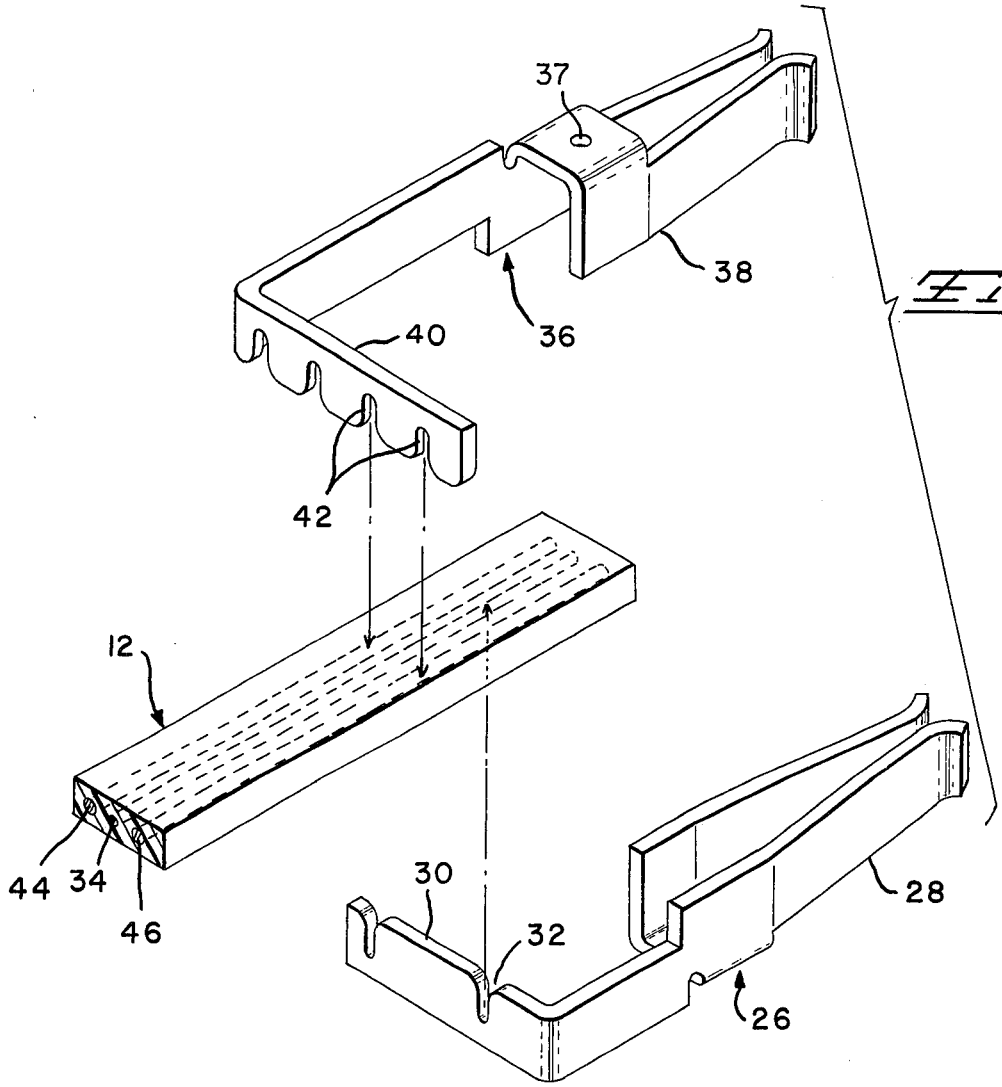
FIG. 2 is a perspective view of the contacts of the subject connector exploded away from the end of a cable to be terminated.
Figure 3:
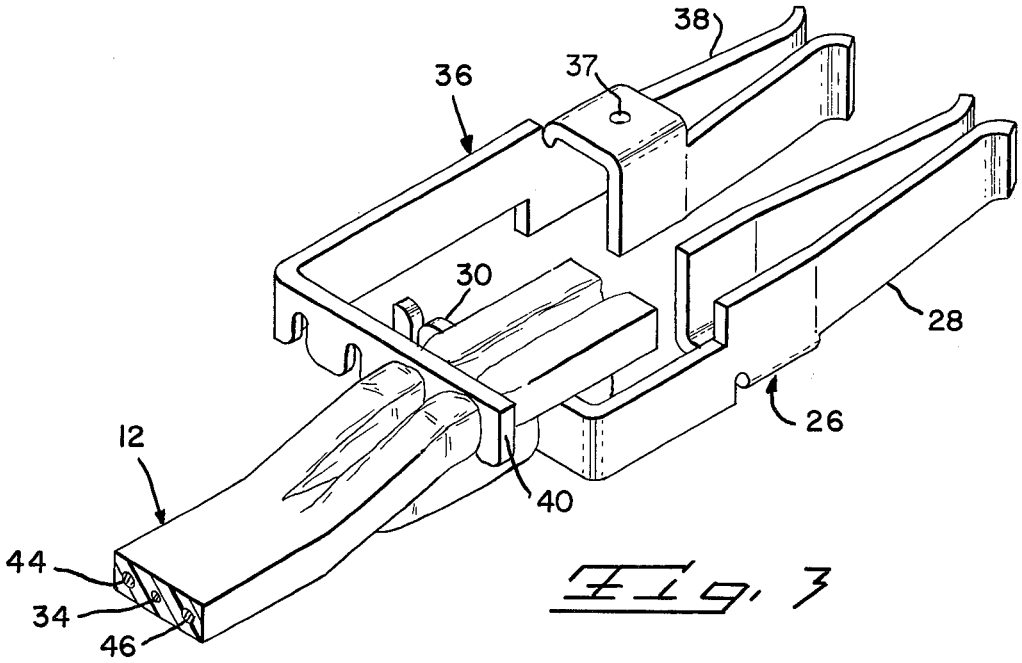
FIG. 3 is a view similar to FIG. 2 showing the contacts engaged with the cable.

The subject connector assembly 10 is shown in FIG. 1 in an open condition ready to terminate a pair of trilead cables 12, 12' of known construction. The connector assembly 10 comprises mating top and bottom housing members 14, 16, respectively joined together along one adjacent marginal edge by a hinge member 18. The housing members together define a first contact recess 20, a second contact recess 22, a contact mounting stud 23 in each recess, and at least one cable receiving recess 24. A first contact 26 includes a mounting aperture (not shown) a mating portion 28 and a cable engaging portion 30 extending normal to the longitudinal axis of the portion 28. At least one insulation displacing slot 32 is formed in portion 28 and adapted to pierce the insulation of the cable 12 to make contact with conductor 34 in a manner to be described below. A second contact 36 includes a mounting aperture 37, a mating portion 38 and a cable engaging portion 40 extending normal to the longitudinal axis of portion 38. At least one pair of insulation displacing slots 42 are formed in portion 28 and adapted to make insulation piercing engagement with conductors 44, 46 of cable 12. The contact 26 is received in recess 20 of member 16 with the slot 32 opening toward member 14 while contact 36 is received in recess 2 of member 14 with the slots 42 directed toward member 16. Each contact is held in place by force fit of the mounting studs 23 in the respective mounting apertures 37. Thus the contacts will engage their respective conductors from opposite sides of the cable when the connector assembly is closed. Both contacts are shown with a receptacle mating portion, but are not so limited since any matable configuration is foreseen. Access to the mating portions of the contacts is through apertures 48 in the hinge member 18.

Each cable receiving recess 24 is defined by a pair of parallel, spaced, integral shoulders 50, 52 on member 16 and an integral rib 54 on member 14. The rib 54 is parallel to shoulders 50, 52 and positioned to fit therebetween in interdigitated fashion when the housing is closed. Cable engaging portions 30 and 40 of contacts 26 and 36, respectively lie in grooves 56, 58, respectively extending transversely across recess 24 in parallel spaced relation. The shoulders 50, 52 are spaced to push against conductors 44, 46, respectively, of cable 12 to drive them into slots 42 of contact 36 while the rib 54 pushes in the opposite direction to drive conductor 34 into slot 32 of contact 26.

The housing assembly further includes a first latching means, comprising lugs 60 on member 16 and detents 62 on member 14, and second latching means comprising lugs 64 on member 14 and detents 66 on member 16. The first latching means is intermediate the ends of the housing assembly while the second latching means is at the end of the housing assembly opposite the hinge member. Both latching means and the hinge member serve to hold the housing assembly closed against the cable. In the event that the hinge member becomes broken, the housing assembly still will remain in the closed condition because of the redundancy of the two latching means. The housing assembly further includes a profiled extension 68 extending from one side thereof. This extension can be gripped by the profiled aperture 70 of a paddle member 72, to be described in detail hereafter with reference to FIG. 8, for ganging several of the subject connector assemblies together.

Figure 6:
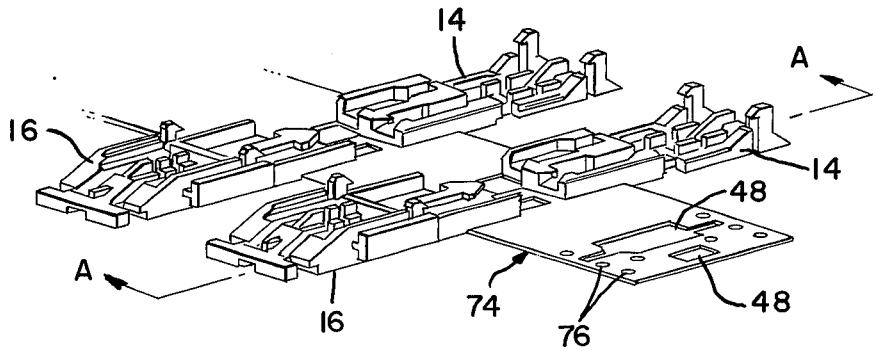
FIG. 6 is a perspective view showing steps of molding a strip of connector assemblies on a web of resilient material which forms the hinge for the assembly.
Figure 6A:
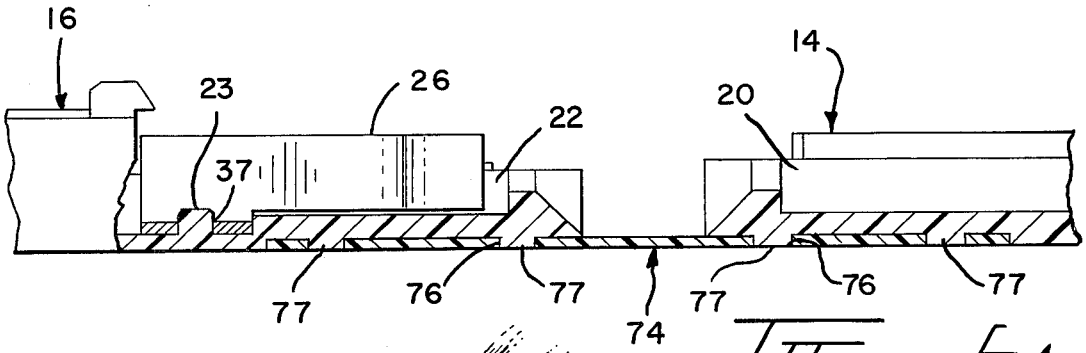
FIG. 6A is a vertical transverse section taken along line A—A of FIG. 6.

The subject connector assembly 10 is preferably manufactured by a method such as illustrated in FIG. 6. A strip of resilient plastic material 74, such as a polyimide, is punched to form a first series of contact access apertures 48 and a second series of apertures 76 each of which includes several radially extending short slits (not shown). The housing members 14, 16 are molded onto carrier strip 74 by any of the well known molding processes. The housing members are mold of a rigid insulating material, such as a filled plastic, and some of the material will flow through apertures 76 to form integral studs 77. The above-mentioned slits allow slight expansion of the aperture to aid in flow of insulation material through the aperture. As the material is cured, the stud 77 thus formed will be gripped by the contracted edges of the apertures to form an integral assembly of the strip and housing members.

Figure 4:
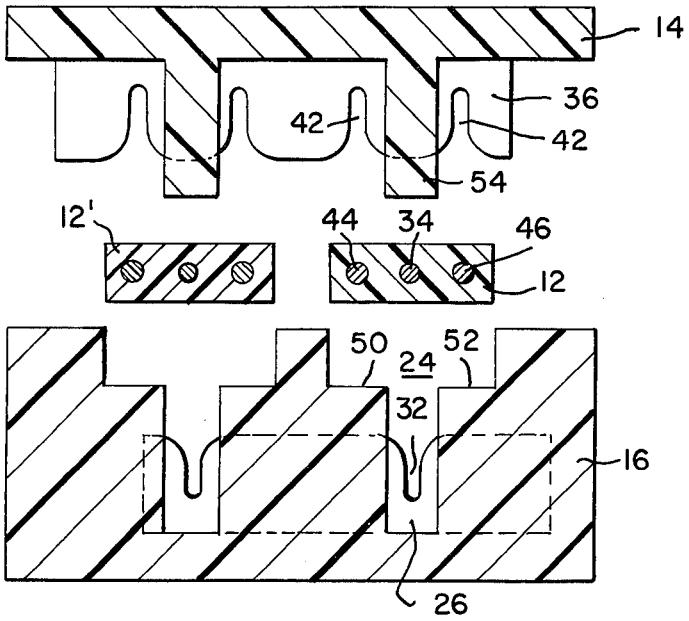
FIG. 4 is a schematic transverse section through the subject cable connector assembly and cable in a exploded condition.
Figure 5:
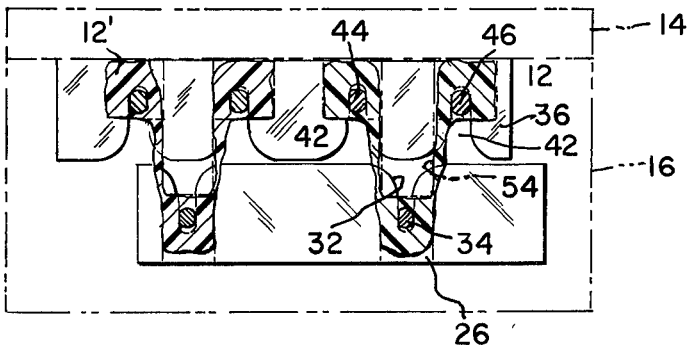
FIG. 5 is a schematic transverse section similar to FIG. 4 showing the subject contacts engaged with the cables.

The connector assembly will normally be furnished in strip form in an open condition, as shown in FIG. 6, and with the contacts in place. The individual connector assembly will be cut from the carrier strip and folded upon itself, as schematically shown in FIGS. 4 and 5, to engage the cable. FIG. 4 shows the housing while still partially opened and with two tri-lead cables positioned to be terminated thereby. Considering only tri-lead cable 12, the outer conductors 44, 46 are positioned in recess 24 above shoulders 50, 52, respectively, and aligned with slots 42 of contact 36. The rib 54 is positioned directly above center conductor 34 and aligned with slot 32 of contact 26. When the housing assembly is fully closed and latched, the conductors 34, 44, and 46 will be driven into their respective slots with the insulation therebetween being distorted and possibly destroyed or even ruptured.

It will be noted from FIG. 5 that the terminated conductors now lie in two planes thereby increasing the spacing between adjacent conductors of the cable. Thus the problem of inadvertant shorting of the conductors is eliminated by providing adequate clearance between the conductors. This also has a further advantage in that the greater clearance allows the use of heavier insulation piercing portions of the contacts to assure proper conductor engagement. This arrangement further obviates the previous requirement for special insulation on the ground conductors of tri-lead cable and for crossing over of the ground conductors for commoning purposes.

Figure 7:
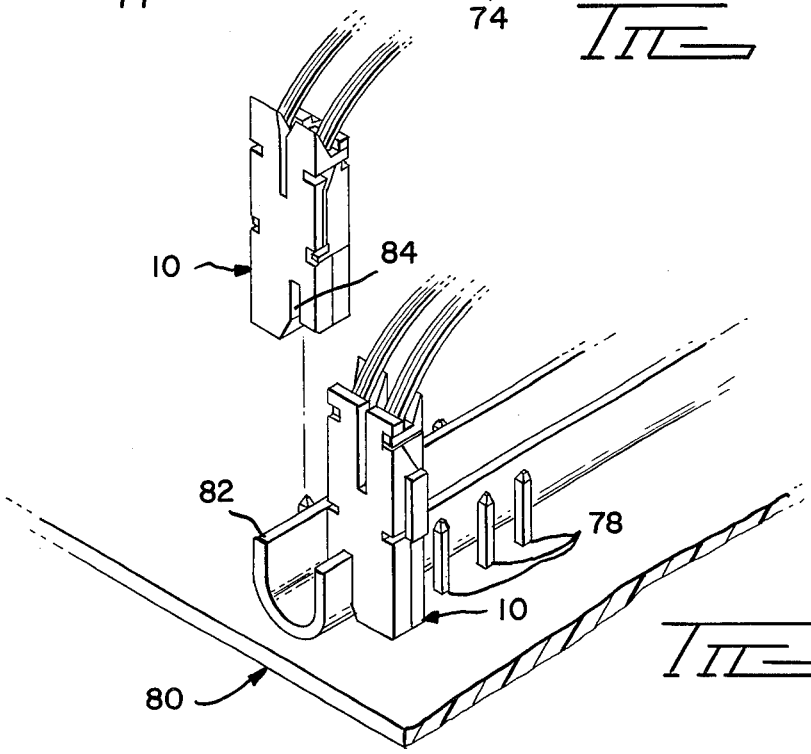
FIG. 7 is a perspective view showing the subject connector assembly engaged in a known pin and rail configuration.

FIG. 7 shows the subject connector assembly as it would be used in a high density configuration mating with a plurality of pins 78 fixed in a parallel spaced arrangement on a circuit board or panel 80 adjacent a channel shaped ground rail 82. In this instance the subject connector assembly housings are provided with a slot 84 allowing engagement of contact 36 with rail 82.

When it is desired to gang the subject connector assemblies together, a paddle 72 in FIG. 8 is used. The paddle 72 includes a plurality of profiled apertures 70 in which the projections 68 are received. Thus a gang of connector assemblies can be inserted or removed with greater ease than with individual connectors. The paddle 72 provides a greater gripping surface which should prevent technicians from pulling on the cables of the individual connectors in an attempt to remove them in a somewhat lazy fashion which likely would eventually result in completely stripping the cables from their connector assemblies.

Figure 9:
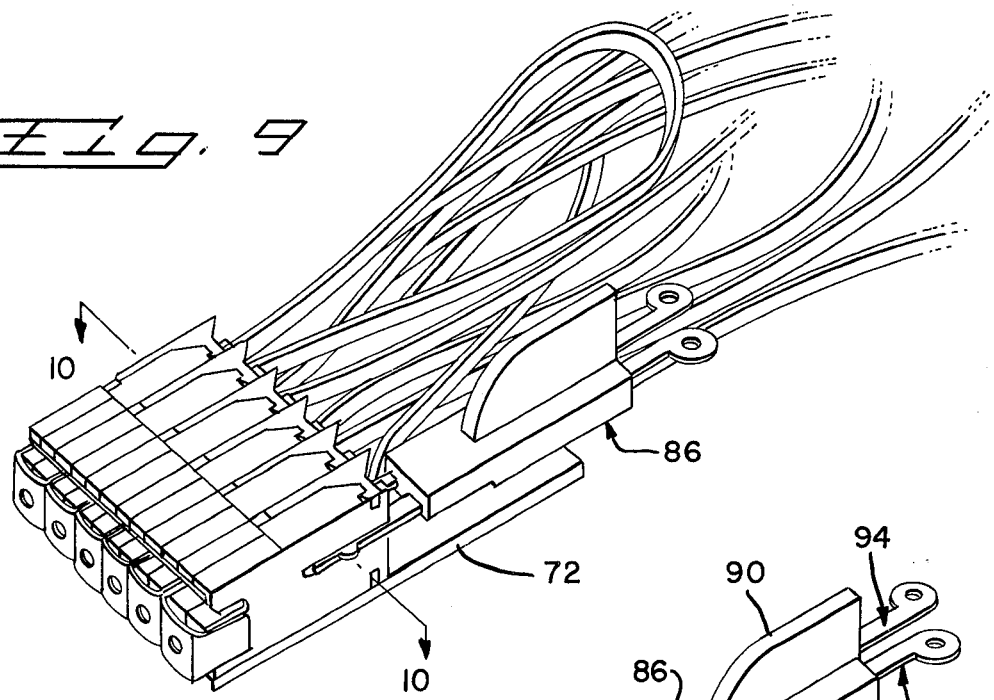
FIG. 9 is a perspective view of a gang of the subject connector assemblies as viewed from the side opposite the paddle board and with a probe in place.
Figure 11:
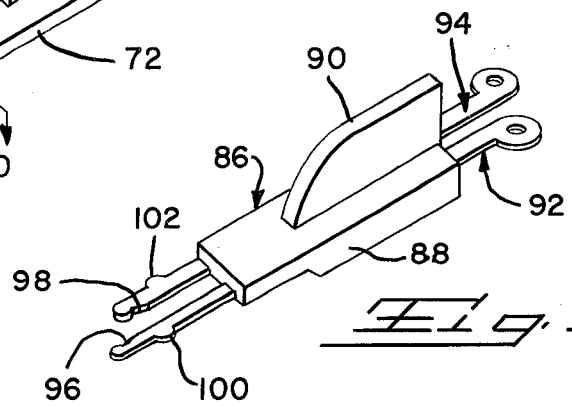
FIG. 11 is a perspective view of a probe for use in connection with the subject connector assembly.
Figure 10:
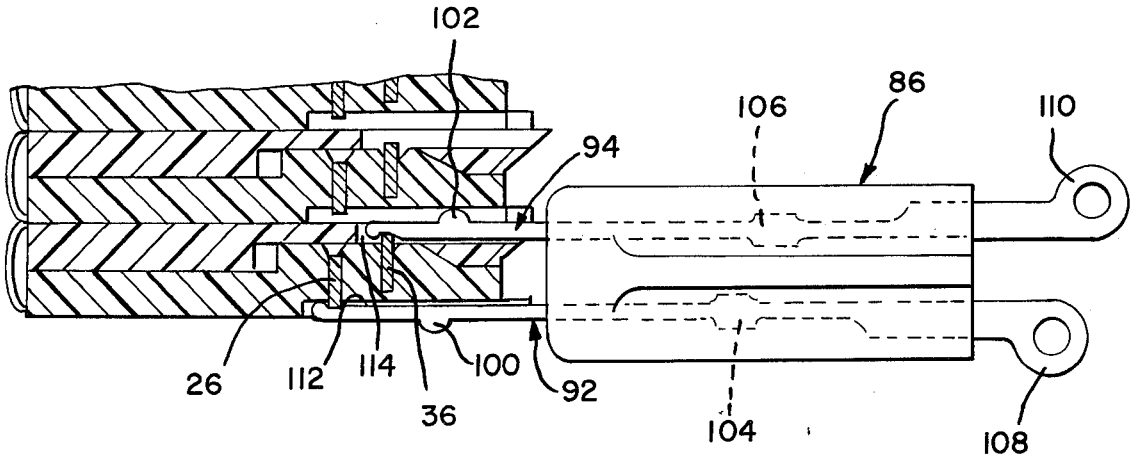
FIG. 10 is a transverse vertical section taken along line 10—10 of FIG. 9.

FIGS. 9 and 10 show how the probe of FIG. 11 can be used to check the continuity of the contacts. The probe 86 comprises a profiled housing 88 having an integral gripping blade 90. First and second rigid conductor members 92 and 94 are molded into the housing. Each conductor member has a contact engaging notch 96, 98, an anti-shorting lug 100, 102, a profiled area 104, 106 for gripping the housing material, and a monitoring head 108, 110.

It will be noted that the first or signal conductor 92 is larger than the second or ground conductor 94. This will allow the probe to be inserted into the housing only with the correct alignment. The members 92, 94 pass through slots 112, 114, respectively, of the housing to engage contacts 26 and 36, respectively. The anti-shorting lugs 100, 102 engage the adjacent housing members and insure that the conductor member only engage the contacts of the conductor being checked. Continuity would be ascertained in the standard manner by the use of conventional test equipment.

Figure 12:
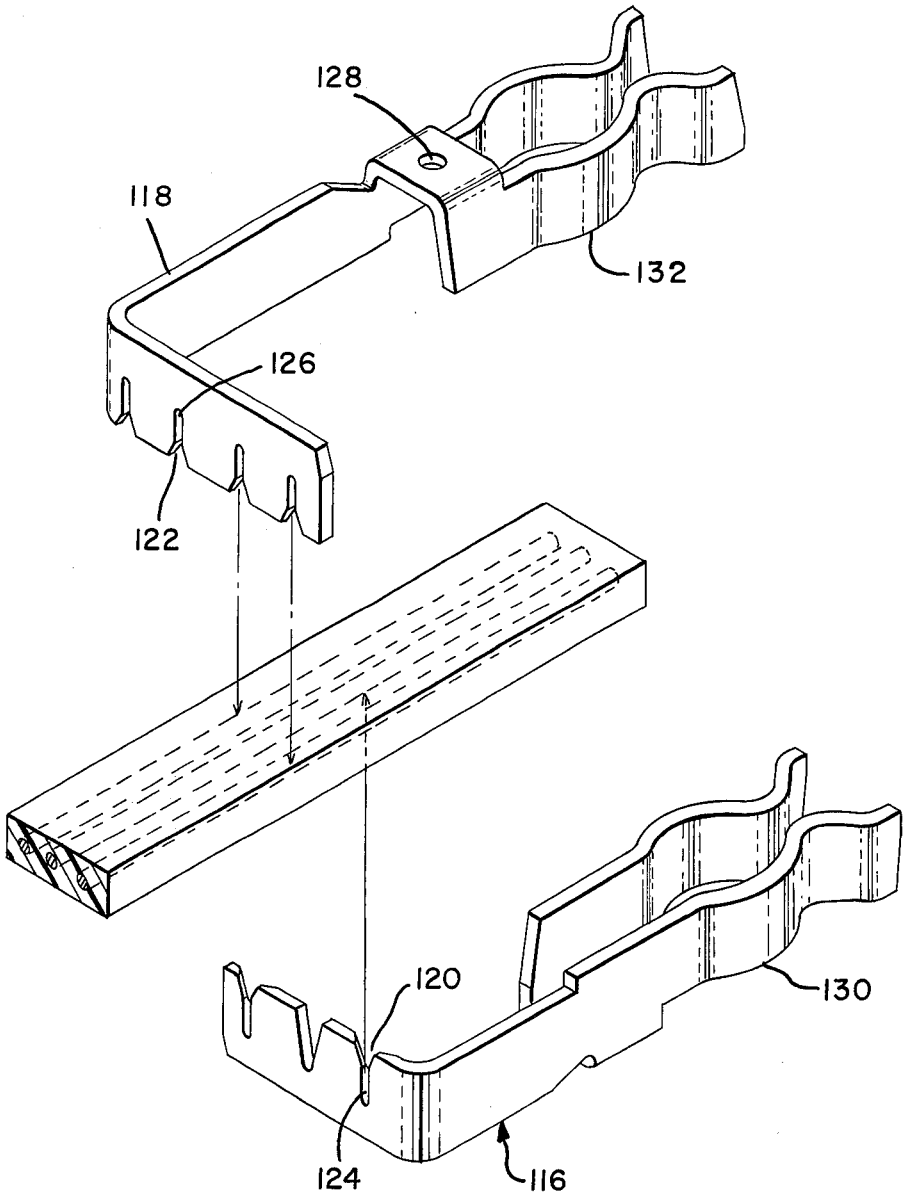
FIG. 12 is a perspective view, similar to FIG. 2, showing an alternate embodiment of the contacts for the subject connector.

A somewhat modified embodiment of the subject contact are shown in FIG. 12. The signal contact 116 and ground contact 118 both have angled, chamfered conductor openings 120, 122 feeding into the respective insulation displacing slots 124, 126. This profiled lead gathers the strands of the conductor before they are inserted into the slot and thus reduces th possible risk of severing of the conductors.

The contacts are also each provided with an aperture 128 which will engage with force fit on an integral stud 77 in the contact recess of the housing. This will help to both locate and hold the contacts in the housing when it is in an open position, such as shown in FIG. 1.

The mating ends 130, 132 of these contacts have been reprofiled to provide greater force against the mating contact received therein.

The present invention may be subject to many changes and modifications without departing from th spirit or essential characteristics thereof. The above-described embodiment should therefore be considered in all respects as illustrative and not restrictive of the scope of the inventon.

What is claimed is:

1. An electrical connector assembly for terminating multi-conductor cable with contacts enabling electrical connection with other electrical terminating means comprising:

a connector housing having first and second mating housing members of substantially rigid first insulator material, said mating members together defining therebetween at least first and second contact receiving cavities and at least one cable receiving recess, and at least one integral stud on each said housing member;

hinge means joining said housing members together and comprising a web of flexible second insulator material having a plurality of apertures therein, said studs of said mating housing members passing through said apertures and being bonded thereto thereby forming an integral housing assembly;

latching means integral with said housing members spaced remote from said hinge means and adapted to detachably secure said mating members together in a closed condition;

a first contact having an insulation piercing conductor engaging portion and a matable portion, said first contact being received in said first cavity of said first housing member with said conductor engaging portion directed toward the second of said housing members, a second contact having an insulation piercing conductor engaging portion and a matable portion, said second contact being received in the second cavity of said housing member with said conductor engaging portion directed towards the first of said housing members; and said at least one cable receiving recess having a transverse profile defined by at least two members fitting together in an interdigitated fashion whereby adjacent conductors of a cable inserted therein will be displaced in opposite directions into two parallel spaced planes and be driven into engagement with the conductor engaging portions of the respective contacts.

2. An electrical connector assembly according to claim 1 further comprising:

a profiled member integral with and extending from one side of said housing assembly; and a paddle member having a plurality of profiled apertures therein whereby a plurality of said connector assemblies can be held together in gang fashion by said paddle member.

3. An electrical connector assembly according to claim 1 wherein said latching means comprises at least two pairs of latch members and detents, each said pair being spaced from each other and from said hinge means.

4. An electrical connector assembly according to claim 1 wherein the matable portion of each said contact comprises a receptacle.

5. An electrical connector assembly according to claim 1 further comprising at least one slot in the outer surface of each said housing member, at the end opposite said hinge means, said slots exposing at least a portion of the respective contacts whereby the contacts can be probed for continuity.

6. An electrical connector assembly according to claim 1 wherein said insulation piercing portions of said contacts extend substantially normal to the mating portions of said contacts.

7. An electrical connector assembly according to claim 1 wherein each said contact has a plurality of insulation piercing slots.

8. An electrical connector assembly according to claim 1 wherein said second contact has insulation piercing slots arranged in pairs spaced to lie on either side of an insulation piercing slot of said first contact.

9. An electrical connector assembly according to claim 1 wherein each said contact has at least one insulation displacing conductor engaging slot and an angled, chamfered lead in to each said slot.

10. An electrical connector assembly according to claim 1 further comprising an integral stud in each said first and second cavity, and an aperture in each said first and second contact adapted to receive the respective stud therein in force fit whereby said contact will be properly located within the respective housings and held therein when the housings are open.

11. An electrical connector assembly according to claim 1 wherein said cable is tri-lead cable, and said cable receiving recess is defined by a pair of parallel spaced shoulders on said first mating housing member and a rib on the second said mating housing member, said rib being positioned to lie between said shoulders whereby closure of said housing causes the outer conductors of said tri-lead cable to be drive in one direction to a fist plane by said shoulders and the central conductor to be driven in the opposite direction to a second plane by said rib.

* * * * *